US005131663A

United States Patent [19]

Klein

[11] Patent Number: 5,131,663

[45] Date of Patent: Jul. 21, 1992

[54] BOARD GAME WITH TWO PLAYING AREAS

[76] Inventor: David Klein, 138 Paulet Rd., Camberwell, London SE 5, England

[21] Appl. No.: 692,628

[22] Filed: Apr. 29, 1991

Related U.S. Application Data

[63] Continuation of Ser. No. 215,501, Jul. 6, 1988, abandoned.

[30] Foreign Application Priority Data

Jul. 6, 1987 [GB] United Kingdom ..... 8715816

[51] Int. Cl.[5] ..... A63F 3/00

[52] U.S. Cl. ..... 273/256; 273/243

[58] Field of Search ..... 273/243, 256, 261

[56] References Cited

U.S. PATENT DOCUMENTS

| | | | |
|---|---|---|---|
| 1,635,735 | 7/1927 | Ziegler | 273/243 |
| 2,177,078 | 10/1939 | Raizen et al. | 273/249 |
| 2,602,667 | 7/1952 | Poarch | 273/243 |
| 4,279,422 | 7/1981 | Shaw | 273/243 |
| 4,544,162 | 10/1985 | Ferris et al. | 273/242 |

FOREIGN PATENT DOCUMENTS

| | | | |
|---|---|---|---|
| 1120642 | 7/1968 | United Kingdom . | |
| 1227862 | 4/1971 | United Kingdom . | |
| 1129581 | 10/1988 | United Kingdom . | |
| 2203355 | 10/1988 | United Kingdom | 273/243 |

*Primary Examiner*—Theatrice Brown
*Assistant Examiner*—William M. Pierce
*Attorney, Agent, or Firm*—Hoffman, Wasson & Gitler

[57] ABSTRACT

The invention concerns a game based on the music business comprising a board means (12) resembling a double album foldable sleeve, consisting of two separately marked game playing areas (15,26) each having a plurality of distinct compartments (15B,27-28), random number selector means (22-24,51), a plurality of distinct counters (50), a plurality of instruction cards (16-20), a form of artificial currency, award indicators (52) and rules consisting essentially of the following:

a) in each of the playing areas the players move from compartment to compartment following the instructions b) while playing in the first playing area the players go round (normally in a single direction) and accumulate money (from a bank holding the money supply).

c) in the second playing area the players move from a start end to an award end but normally can select in which direction they move on any turn. During this movement the players are obliged to pay money to the Bank but can collect awards.

d) the winner is the first player to collect a preselected number of awards/points or to have collected the most awards when the players decide to finish the game.

e) all players start in the first playing area but can move to the second playing area and back to the first playing area as they decide, probably subject to certain limitations on the position in either playing area from which they can move to the other playing area.

23 Claims, 5 Drawing Sheets

BOARD GAME WITH TWO PLAYING AREAS

This is a continuation of copending application Ser. No. 07/215,501 filed on Jul. 6, 1988, now abandoned.

BACKGROUND OF THE INVENTION

This invention relates to a game based on the music business.

An object of the invention is to provide a game in which the instructions, rules and awards are derived from current business practice in the music industry and which has additionally rules of play and set up of board which are different from other games.

SUMMARY OF THE INVENTION

In one form the invention provides a game comprising a board means consisting of marked game playing areas having a plurality of distinct compartments, at least some of which compartments are marked with instructions including instructions to take an instruction card, random number selector means, a plurality of distinct counters, a plurality of instruction cards a form of artificial currency (hereinafter called money), award indicators and rules consisting essentially of the following:

a) in the playing areas the players move from compartment to compartment according to the number selected by a random number selector and follow the instructions on the compartments and cards, b) while playing the players go round (normally in a single direction) and accumulate money (from a bank holding the money supply), the players are also obliged to pay money to the Bank but can collect awards.

d) the winner is the first player to collect a preselected number of awards/points or to have collected the most awards when the players decide to finish the game.

characterised in that the board is marked with two distinct playing areas each associated with a different aspect of the music business and in that, the compartments of the first playing area and instruction cards associated therewith predominantly consist of instructions which result in the player accumulating money, and the compartments of the second playing area and instruction cards associated therewith consisting of instructions which result in a player spending money while acquiring awards/-points, and according to the rules all players start in the first playing area but can move to the second playing area and back to the first playing area as they decide, preferably subject to certain limitations on the position in either playing area from which they can move to the other playing area. Skill lies in deciding when to move from one to the other of the playing areas.

Preferably the players collect awards both by staying in one of a plurality of pre-selected parts of the second playing area for a pre-set consecutive number of moves and by landing on the award compartment.

In a preferred form of the game the first playing area represents the music dealing business and the instructions on the compartments and the instruction cards associated therewith represent different deals and activities preferably at least some of which are selected from promotional deals, publications deals, recording deals and merchandising deals.

Preferably the second playing area represents the music charts with players moving up the charts from the start end to the award compartment which represents number one in the charts.

With advantage a part of the second playing area adjacent the award compartment is designated the platinum disc area and comprises for example eight compartments (from seven to nine compartments); a further part of the board next to the platinum disc area and designated a gold disc area comprises sixteen consecutive compartments (from 14 to 18 consecutive compartments) and a third part of the second playing area next to the gold disc area and designated the silver disc area comprises 24 consecutive compartments (from 20 to 28 consecutive compartments). With advantage awards of different values can be won by landing on the award compartment, staying in the platinum disc area for four consecutive moves, staying in the gold disc area for three consecutive moves or staying in the silver disc area for two consecutive moves.

Preferably, players cannot return to the first playing area from the second playing area, in order to make more money, without going down the charts towards the start at least until out of the award winning parts areas, except that a player landing on the award compartment may be allowed to go straight out of the award winning areas and immediately start playing on the first playing area.

Preferably the board is constructed in the form of a double album sleeve with the two playing areas on the two halves which normally fold together but can be opened out for play. Preferably the board is of square shape similar in size to a record album that is approximately of side 30.5 cm.

With advantage the first playing area is an annulus and this first part includes a spinable pointer mounted at its centre and is marked out with one or two rings of randomly arranged numbers thus providing a random number selector. Preferably two rings respectively have 20 and 40 numbers representing the top twenty and the top forty. With advantage the second playing area has the compartments arranged in a spiral and numbered consecutively with one at the centre. The instruction cards associated with the second playing area may be divided into good cards which help the player and bad cards which hinder the player, the instruction cards having appropriate names and instructions thereon.

Preferably the game includes tokens which can be collected by the players as they move round one or both playing areas, these tokens including some (chokers) which can be used to obstruct or cancel another player's turn and some which allow the players to select or change the number of places to be moved at a turn instead of throwing the dice. Preferably the random number selection means includes two dice and a number of the compartments are marked with an indication to throw the dice or spin the pointer to determine how much money is won or paid out.

The game may include quiz cards. In this case money making deals can only be carried out if the quiz question is correctly answered first.

BRIEF DESCRIPTION OF THE DRAWINGS

An embodiment of game, in accordance with the invention, will now be described, by way of example only, with reference to the accompanying drawings of which.

DETAILED DESCRIPTION OF ONE EMBODIMENT

Figure 1:
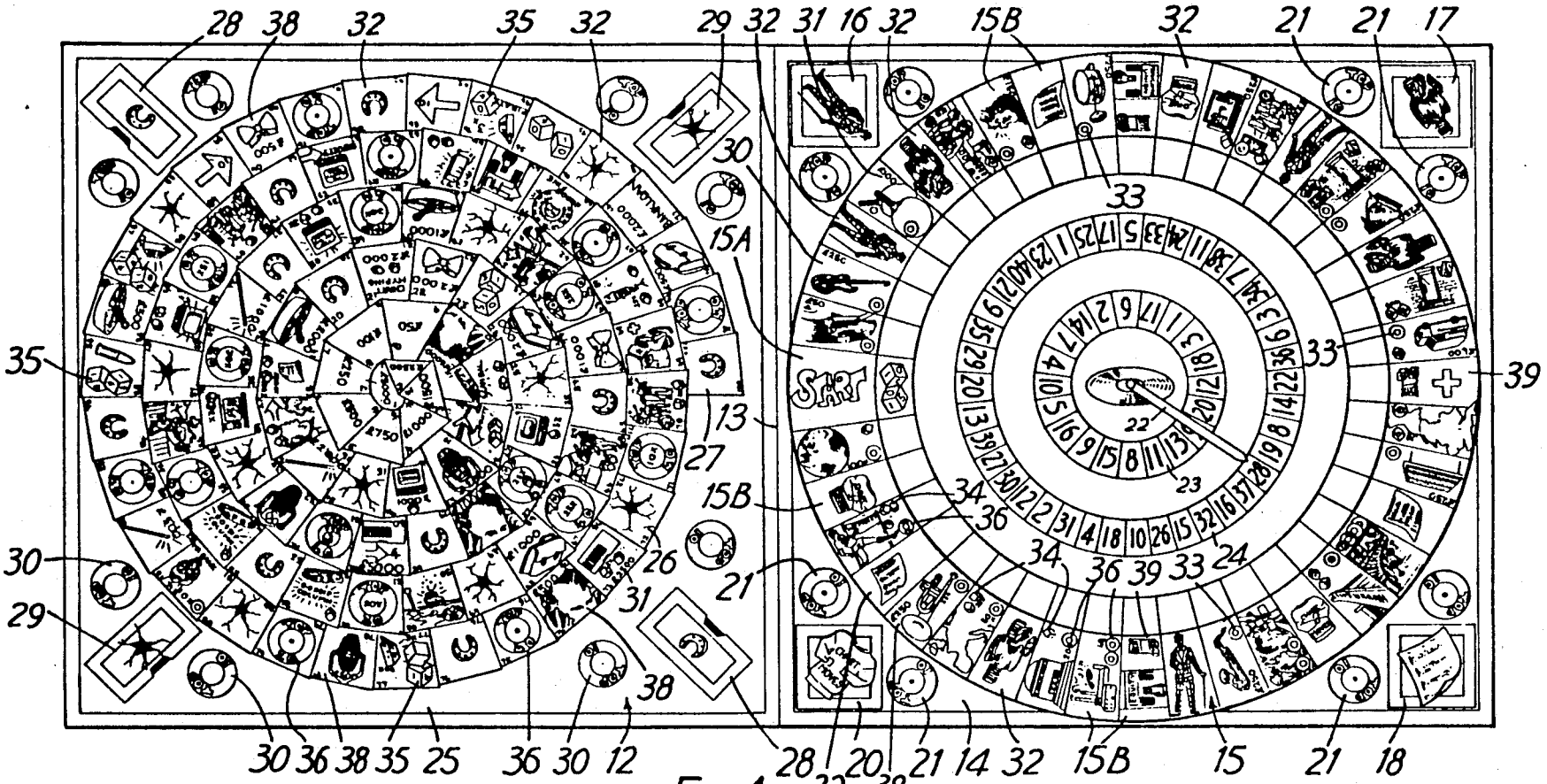
FIG. 1 shows the board which forms part of the game.
Figure 2:
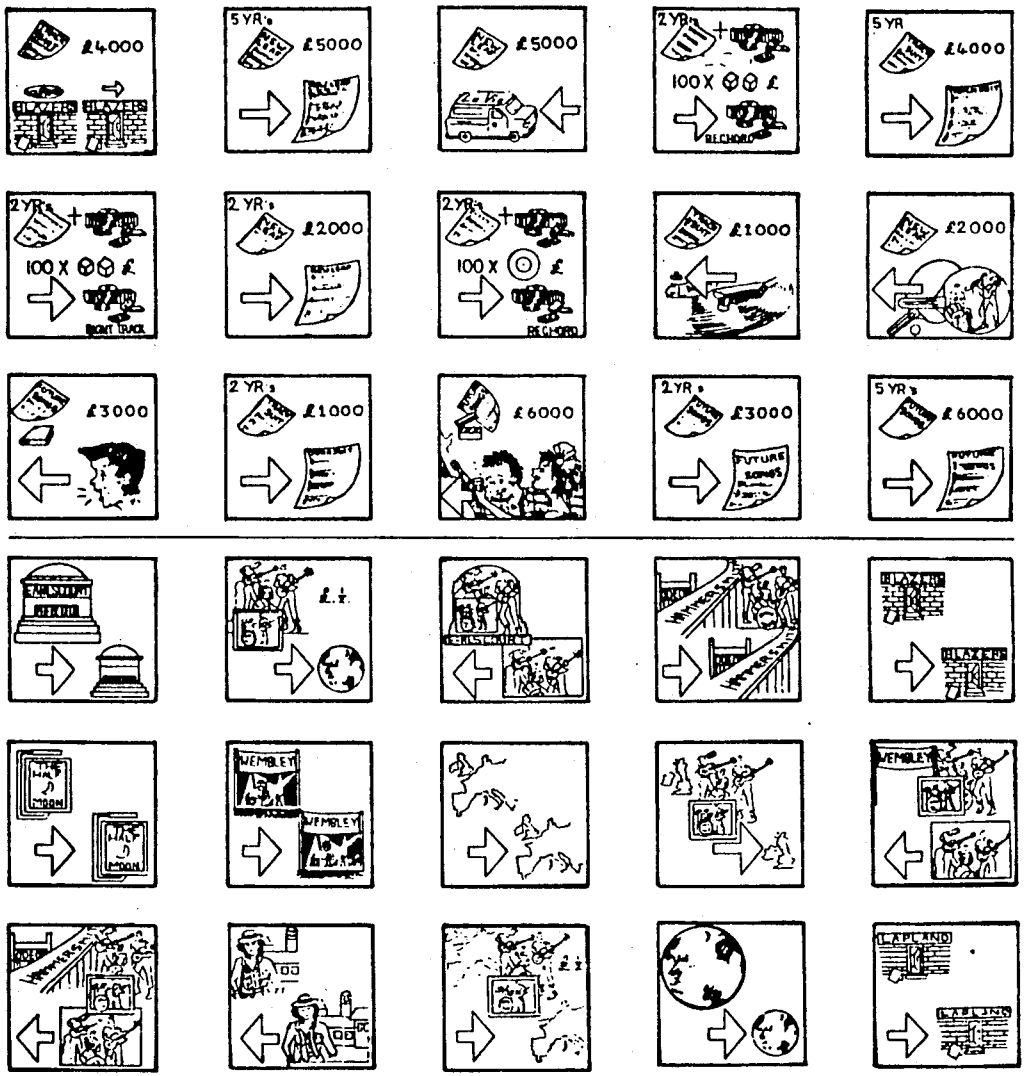
FIGS. 2 to 4 show various forms of instruction card.
Figure 3:
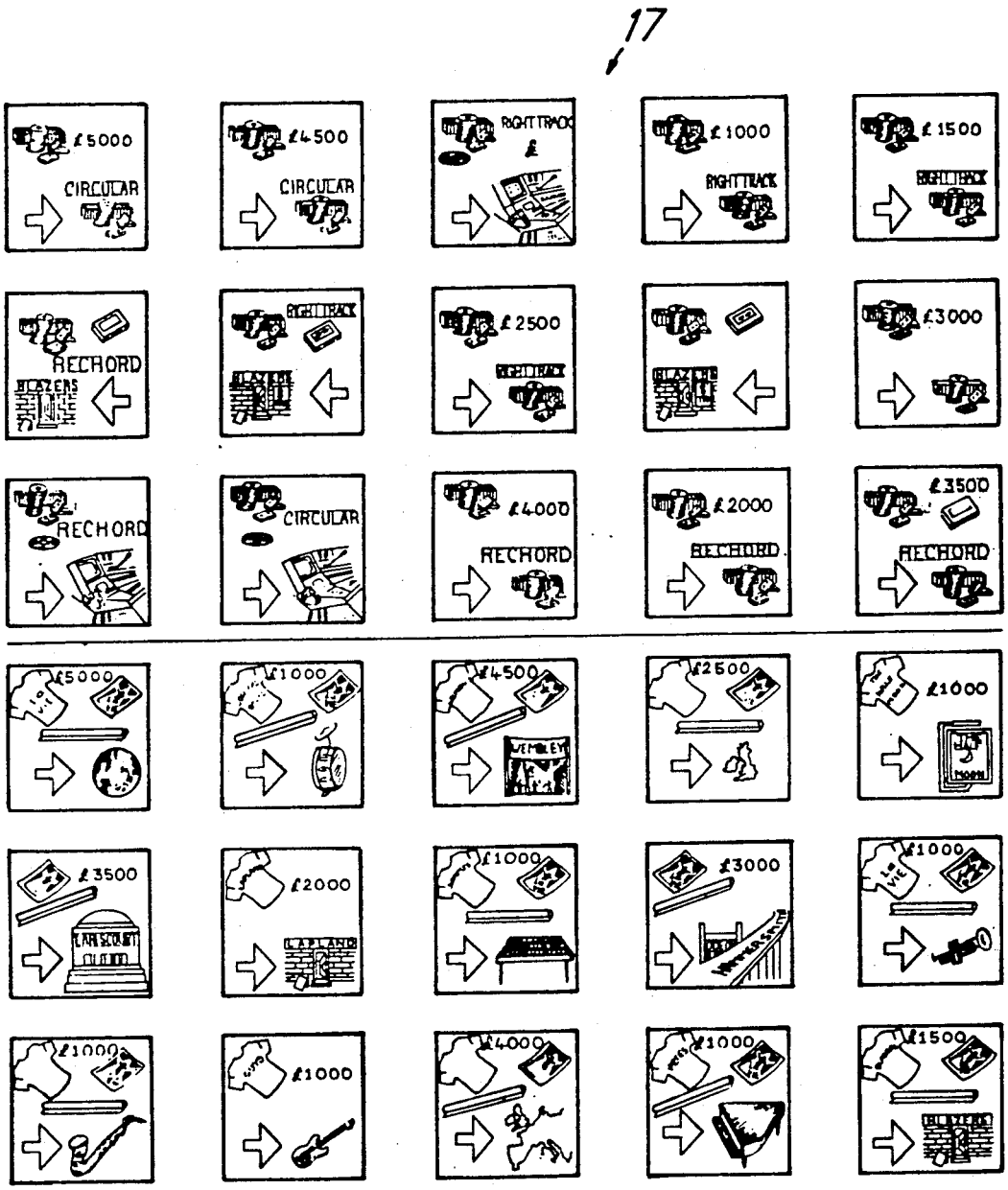
Figure 4:
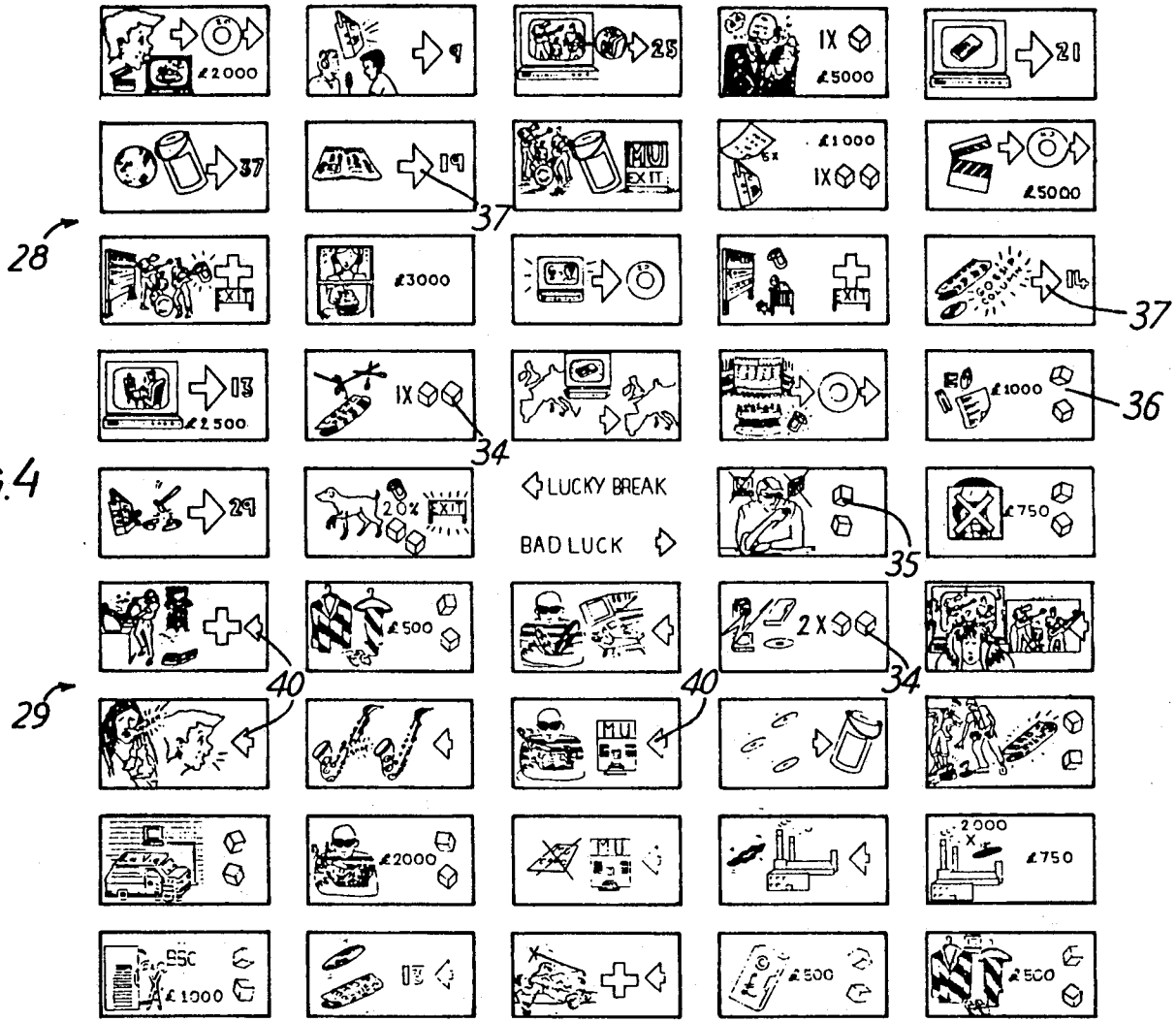
Figure 7:
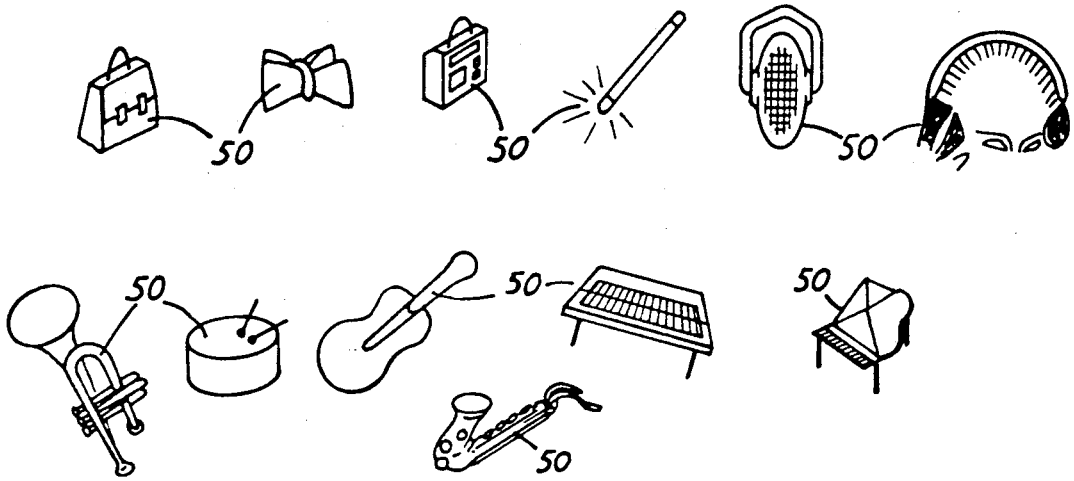
FIG. 7 shows a random selection means and counters.
Figure 6:
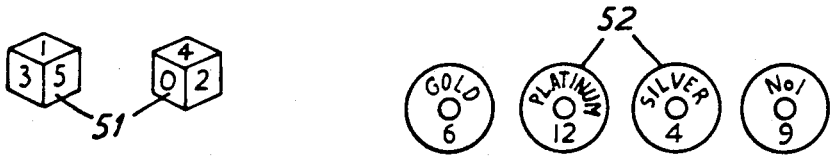
FIG. 6 shows award/point tokens.
Figure 5:
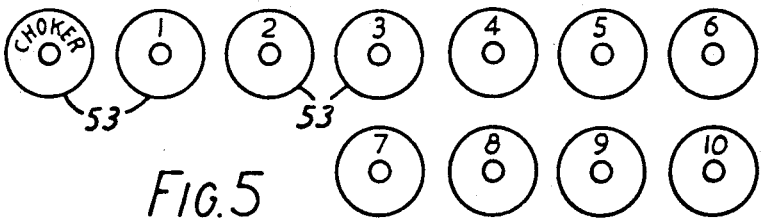
FIG. 5 shows various top ten tokens.
Figure 8:
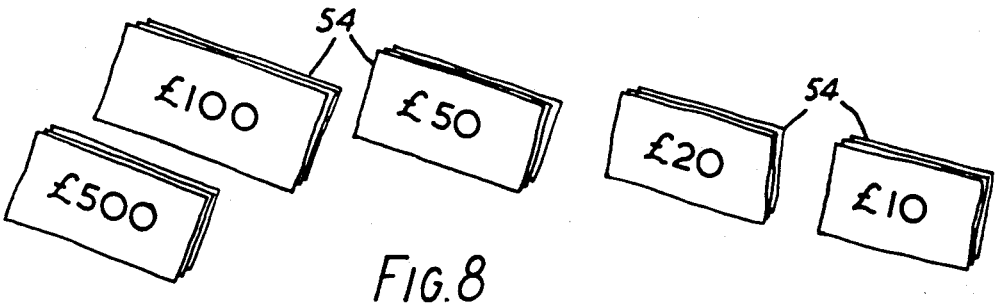
FIG. 8 shows a form of paper currency.

The Game is called Chart Moves. The board 12 is formed as a double album sleeve comprising two similar squares of side 30.5 cms connected along one edge 13 forming a hinge so that the two halves can fold together or be laid out alongside one another as illustrated. One half 14 is designated with a first playing area 15 divided into forty discrete compartments arranged in an annulus, one 15A of which is designated as a start compartment. The other compartments 15B each have instructions thereon and at the corners of the board are marked four squares for holding four sets of cards, set 16 concerning promotional deals, set 17 concerning recording deals, set 18 concerning publishing deals and set 20 concerning merchandising deals. There are also spaces 21 marked for top ten tokens. At the centre of the board is mounted a spinable pointer 22 and arranged around the centre and inside the playing area are two annuluses of randomly arranged numbers a first annulus 23 of twenty numbers and a second annulus 24 of forty numbers.

The second half 25 of the board is marked with a playing area 26 comprising one hundred separate compartments arranged spirally from a start compartment 27 at the outside numbered one hundred to an award compartment 28 at the inside numbered one. At the corners of this part of the board are positions for a set of good luck cards 28 and a set of bad luck cards 29 and further positions 30 for top ten tokens.

On both parts of the board the compartments indicate instructions for any of the following: an instruction 31 for the receiving or the paying of money, normally depicted in black for receiving and red for paying; an instruction 32 (normally a picture) for instructing the taking of an instructing card; an instruction 33 (normally a picture) indicating that one or more top ten tokens are to be collected, an instruction 34 indicating that one or two dice should be thrown and the player should then move on or back this number of places, an instruction 35 (one or two dice in red) indicating that the player should miss this number of turns, an instruction 36 indicating that the player should spin the pointer and apply either the top twenty or top forty numbers or throw the dice and collect or pay money equivalent to these numbers sometimes multiplied by a multiple indicated on the compartment; an instruction 37 to move on or back a number of places; an instruction 38 to pay money to another player (picture corresponds to counter); an instruction 39 to stay at the position indicated (e.g. hospital) until a particular combination of dice is thrown; an instruction to return to a compartment of the first playing area, or sometimes combinations of these instructions.

The game also comprises a number of individual counters 50 for the players to move from compartment to compartment on the playing areas, two dice 51 each numbered from 0 to 5, some award/point indicators 52 and some top ten tokens 53 having backs saying "Top 10" and fronts, as shown, labelled "choker" or a number from 1 to 10 and some artificial paper currency 54.

The instruction cards associated with the first playing area have backs with the appropriate picture and show money to be collected together with a movement to be made forwards or backwards to the next compartment indicated by a picture, where the instructions on that compartment should again be followed.

The good luck (lucky break) cards show money to be collected and movements forwards to be made sometimes indicated to be determined by throwing the dice or spinning the pointer.

The bad luck cards similarly indicate money to be paid, moves to be moved back (sometimes onto the first playing area as indicated by a picture) or turns to be missed.

THE RULES

The General Thrust of the Game

Before starting players decide the length of the game, either in time (e.g. three hours) or by fixing a number of points of which the first player to reach that number wins E.g: 125 points will yield a game that lasts about 2½ hours.

Players score points/awards by winning either a platinum disc, gold disc, silver disc, or a number one hit. These are worth the following points:

Platinum Disc 12 points
Number One Hit 9 points
Gold Disc 6 points
Silver Disc 4 points By spending money on the MUSIC BIZ BOARD players can also pick up Top Ten Cards including Choker Cards for use on the CHART BOARD. Top Ten Cards can be played to help players reach a chart position stated on the card. Choker cards can manipulate opponents' moves and block them from reaching chart positions they want to reach.

As an optional extra players can also choose whether to play with the MUSIC QUIZ cards—which allow you to show off your knowledge of pop music. Whether you get a correct answer or not determines whether you can play your next move, or can complete the deal you're involved in.

How to Start the Game

First choose your pieces. You will need two—one for each board. For the MUSIC BIZ BOARD choose between a briefcase (the Manager), a bow tie (the Agent), a radio (the Plugger), a magic wand (the Producer), a microphone (the D-J), and the headphones (the Engineer). Whichever role you choose you will have to play that role at the appropriate times when a deal is to be made. For the CHART BOARD choose between a guitar, drum, piano, synthesiser, saxophone and trumpet. Place your pieces in the start positions.

Each player starts with £2500. The rest of the money goes in the bank.

Select who is to start by rolling the two dice. The highest number starts.

Playing the Music Biz Board

This player throws both dice, which are numbered 0–5 instead of 1–6, and counts their piece along to the right position. He/she then obeys the instructions on that position.

Suppose you land on a space where you have to make a deal. This you conduct with the bank. It is easy to see whether the deal involves paying out or receiving money; the former is shown in red, the latter in black. You then may have to make another move if that is designated on the square you've landed on. You should obey the instructions on that square, and so on until you can go no further and your entire move is completed.

Instructions on the square may tell you to either spin the roulette wheel or throw the dice and multiply the result by an amount shown in pounds to determine how much money you have to spend or receive. E.g., if it reads '5×amount' and you throw an 8, the figure is £40. If you make money, then the banker issues the money to the player.

You may complete a deal which allows you to pick up a Top Ten Card—a small number of which are the much desired Choker Cards (See Rule). This you should do. However, you are not allowed to keep more than four at any one time. If you have four and pick up another you must discard one of the ones you are holding. It is your choice which one.

The next player then throws the dice and repeats the procedure. Continue round the board in this fashion. If you land on a space occupied by another piece, ignore it.

During this time you should be making money. You don't score points. This is the money you will spend on the other board to score your points.

To get out of the Musicians Union space you must throw an even number on the dice; to escape from Equity you must throw an odd number; and release from hospital only comes through throwing a pair.

When you've returned to the START position. It's time to evaluate your cash flow situation. Only when your piece is in this position or has just passed it, can you commence your assault on the charts. Otherwise you must continue round the board again—and you may do this as many times as you like amassing a fortune—but it won't necessarily help you win the game. It is recommended that you need AT LEAST £10,000 to grease your way up to that covetted top of the pops.

Playing the Chart Board

Now switch to your chart piece which will be in the ready, steady throw position. Leave your other piece where it is so you can come back to it. Each space on this board represents a chart position and also determines how much money you've got to spend to be there. You can also land on a space that tells you to pick up a Luck Break card—which lets you make money. Or a Bad Luck card—that's life. Different colours also show what positions qualify for what awards. These are as follows:

Platinum Disc Stay Between Nos: 2–9 for 4 moves (going both up and down)

Number One You must land exactly there for one move

Gold Disc Stay between Nos: 10–25 for 3 moves (going either up or down)

Silver Disc Stay between Nos: 26–49 for 2 moves (going either up or down)

Throw the dice and obey whatever instructions appear on the position on which you land. If you owe money, pay it to the banker or professional concerned (promoter, recording engineer, d-j. etc.,) as shown by the picture.

You may have to pick up a Lucky Break or Bad Luck card; you will of course obey the instructions.

When you approach the silver and platinum areas it is important to use your judgement to determine when and where you deploy your Top Ten and Choker Cards. Top Ten Cards enable you to move to a predetermined position to curtail or extend your time in a given area. Choker Cards enable you to block an opponent, who may not land on a space determined by the throw of their dice if you deploy the choker card at that point. They must instead return to their original position for one move, having lost that move and losing the Top Ten card, if they deployed one, in the process.

[Example: an opponent is going down the chart in the platinum area and has already been there for three moves. They are on number 4 and throw a two, aiming for number 6. You can then throw your Choker Card down to block their move. They lose the move, stay where they are, and you lose your Choker Card. If they deployed a Top Ten card at that point they also lose that.]

If two players throw down choker Cards at the same time, the one next in line to go has priority.

The awards also have a monetary value and may be used for collateral in needy times and surrendered to the bank for their value. These are:

Platinum Award £20,000
Number One £15,000
Gold Award £10,000
Silver Award £7,000

Awards are however given a sign of esteem not for their monetary value.

Players can also declare themselves bankrupt and withdraw from the game entirely. The industry rewards winners and ignores losers.

To score a Number One you must land exactly on the position.

When you have reached it you can start climbing back down the charts to position 50 or return there directly, depending on how much cash you have left—it's your choice. At any point from now on you may remove your piece to the throw position and resume playing on the MUSIC BIZ BOARD to build up more cash for your next assault. If you have enough money left by then, you may however prefer to climb gracefully down the chart, accruing more points on the way by staying in the platinum/gold/silver regions for the specified length of time.

Thus, it is feasible to obtain gold and silver discs on the way up AND on the way down.

Continuing and Finishing the Game

Players continue in this fashion, moving from one board to the other. At any point players may be on both boards, although an individual player will only play on one board at a time.

The game is over when the allotted time span has passed and the player with the highest number of points is declared the winner, or when the first player reaches the previously decided number of points and is declared the winner.

What is claimed is:

1. A game for a plurality of players, the game simulating the music business and comprising a board game, random number selector means, a plurality of distinct counters each representing one player during play of a game, a plurality of instruction cards, a plurality of award tokens and rules;

the board defining a playing area defining a plurality of distinct compartments serially linked and representing movement increments of each counter along that area, at least some of the compartments being marked with instructions some of which include an instruction to take an instruction card, the random number selector means having indicia for indicating numbers to dictate the number of increments of movement of the players' counters along the compartments of the playing area of the board, whereby instructions are attributed to each player in accordance with the compartment upon which movement of the player's counter terminates;

each operation of the random number selector means, counter movement, and following of instructions constituting one turn of a player;

the instructions on the compartments and the instruction cards consisting of instructions representing one of a music dealing business occurrence and a music chart occurrence, which instructions result in the players accumulating and spending money and in which the playing area is marked with a plurality of award winning parts, each comprising a plurality of consecutive compartments, the award tokens comprising a plurality of sets of tokens one associated with each such part of the playing area, an award token of a set being won by a player who remains in one of the award winning parts of the playing area for a pre-set plurality of consecutive turns of that player.

2. A game for a plurality of players, the game simulating the music business and comprising a board means, random number selection means, a plurality of award tokens and rules;

the board defining a playing area defining a plurality of distinct compartments serially linked and representing movement increments of each counter along the area, at least some of the compartments being marked with instructions some of which include an instruction to take an instruction card, the random number selection means having indicia for indicating numbers to dictate the number of increments of movement of the players', whereby instructions are attributed to each player in accordance with the compartment upon which movement of the player's counter terminates;

each operation of the random number selection means, counter movement, and following of instructions constituting one turn of a player;

the instructions on the compartments and the instruction cards comprising of instructions representing one of a music dealing business occurrence and a music chart occurrence, which instructions result in the players accumulating and spending money and in which the playing area has the compartments arranged in a spiral and numbered consecutively with one at the center representing the top of a music chart;

the award tokens comprising a plurality of sets of tokens, one associated with each such part of the playing area, an award token of a set being won by a player who remains in one of the award winning parts of the playing area for preset plurality of consecutive turns of that player.

3. A game for a plurality of players, the game simulating the music business and comprising a board means, random number selector means, a plurality of distinct counters each representing one player during play of the game, a plurality of instruction cards, a plurality of award tokens and rules;

the board defining a playing area defining a plurality of distinct compartments serially linked and representing movement increments of each counter along that area, at least some of the compartments being marked with instructions some of which include an instruction to take an instruction card, the random number selector means having indicia for indicating numbers to dictate the number of increments of movement of the players' counters along the compartments of the playing area of the board, whereby instructions are attributed to each player in accordance with the compartment upon which movement of the players' counter terminates;

each operation of the random number selector means, counter movement, and following of instructions constituting one turn of a player;

the instructions on the compartments and the instruction cards consisting of instructions representing one of a music dealing business occurrence and a music chart occurrence, which instructions result in the players accumulating and spending money;

the award tokens comprising a plurality of sets of tokens, one associated with each such part of the playing area, an award token of a set being won by a player who remains in one of the award winning parts of the playing area for a preset plurality of consecutive turns of that player.

4. A game for a plurality of players based on the music business comprising a board means, random number selector means, a plurality of distinct counters, a plurality of instruction cards, a form of money, and rules, the board having two halves which fold together or open out for play, a first of the halves being marked with a first playing area divided into compartments and cards associated with the first playing area including instructions relating to promotional music business deals a majority of which result in the players acquiring money, a second of the halves being marked with a second playing area divided into compartments and having associated instruction cards, the compartments and cards associated with the second playing area relating to a music chart and including instructions a majority of which result in the players spending money and acquiring awards, the second playing area being marked with a plurality of winning parts each including a plurality of compartments and the players acquiring awards by staying in an award winning part for a preselected plurality of consecutive turns, the award tokens comprising a plurality of sets of tokens, one associated with each such part of the playing area, an award token of a set being won by a player who remains in one of the award winning parts of the playing area for a reset plurality of consecutive turns of that player.

5. A game for a plurality of players, the game simulating the music business and comprising a board means, random number selector means, a plurality of distinct counters each representing one player during play of a game, a plurality of instruction cards, a plurality of award tokens and rules;

the board defining first and second separate playing areas, each defining a plurality of distinct compartments serially linked and representing movement increments of each counter along that area, at least some of the compartments of each area being marked with instructions some of which include an instruction to take an instruction card, the players being able to choose in which area their counter will move at different times during play of the game;

the random number selector means having indicia for indicating numbers to dictate the number of increments of movement of the players' counters along the compartments of the areas of the board, whereby instructions are attributed to each player in accordance with the compartment upon which movement of the player's counter terminates;

each operation of the random number selector means, counter movement, and following of instructions constituting one turn of a player;

the plurality of instructions cards including a first set of instruction cards associated with the first playing area and a set of instruction cards associated with the second playing area, the instructions on the compartments of the first playing area and the first set of instruction cards consisting of instructions representing music dealing business occurrences, a majority of which instructions result in the player accumulating money; the instructions on the compartments of the second playing area and the second set of instruction cards consisting of instructions representing occurrences associated with a music chart, a majority of which instructions result in the player spending money while acquiring award tokens; and the second playing area being marked with a plurality of separate award winning parts, each such part comprising a plurality of consecutive compartments, the award tokens comprising a plurality of sets of tokens one associated with each such part of the second playing area, an award token of a set being won by a player who remains in an award winning part for a pre-set plurality of consecutive turns of that player.

6. A game according to claim 5, in which the music dealing business occurrences represent different deals and activities in the music business at least some of which are selected from promotional deals, publishing deals, recording deals and merchandising deals.

7. A game according to claim 6, in which the second playing area represents a music chart with players moving up the chart from a start compartment to an end award winning compartment which represents the top of the chart.

8. A game according to claim 6, one of said parts of the second playing area adjacent an end compartment is designated a platinum disc area and comprises from seven to nine compartments; a further one of the parts of the second playing area next to the platinum disc area and designated a gold disc area comprises from 14 to 18 consecutive compartments and a third one of the parts of the second playing area next to the gold disc area and designated a silver disc area comprises from 20 to 28 consecutive compartments and award tokens of different instructions back to the first playing area.

9. A game according to claim 6, in which the board, having first and second separate playing areas is constructed so that the playing areas coincide with two values are won by a counter staying in the platinum disc area for a predetermined plurality (preferable four) of consecutive players turns, staying in the gold disc area for a predetermined plurality of consecutive player turns or staying in the silver disc area for a predetermined plurality of consecutive player turns.

10. A game according to claim 6 which includes further tokens marked with a numeral indicating the number of positions which can be moved when the token is played which can be collected by the players as they move round one or both playing areas, these further tokens including some which allow the players to select or change the number of increments to be moved at a turn instead of using the random number selector means.

11. A game according to claim 5, in which the second playing area represents a music chart with players moving up the chart from a start compartment to an end award winning compartment which represents the top of the chart.

12. A game according to claim 5 in which the award winning parts each comprise at least seven consecutive compartments and in which at least one other of the compartments is marked as an award winning compartment whereby a player whose counter terminates its movement in an award winning compartment receives an award token.

13. A game according to claim 12, in which the second playing area represents a music chart with players moving up the chart from a start compartment to an end award winning compartment which represents the top of the chart.

14. A game according to claim 12 in which one of said parts of the second playing area adjacent an end compartment is designated a platinum disc area and comprises from seven to nine compartments; a further one of the parts of the second playing area next to the platinum disc area and designated a gold disc area comprises from 14 to 18 consecutive compartments and a third one of the parts of the second playing area next to the gold disc area and designated a silver disc area comprises from 20 to 28 consecutive compartments and award tokens of different values are won by a counter staying in the platinum disc area for a predetermined plurality (preferably four) of consecutive player turns, staying in the gold disc area for a predetermined plurality of consecutive player turns or staying in the silver disc area for a predetermined plurality of consecutive player turns.

15. A game according to claim 12, which includes tokens marked with an indication which will enable a player to block a player's move when that token is played.

16. A game according to claim 12, which includes further tokens marked with a numeral indicating the number of positions which can be moved when the token is played which can be collected by the players as they move around one or both playing areas, these further tokens including some which allow the players to select of change the number of increments to be moved at a turn instead of using the random number selector means.

17. A game according to claim 12, in which the board, having first and second separate playing areas is constructed so that the playing areas coincide with two halves of the board whereby the two halves are connected by a fold line with the two playing areas on the two halves respectively, which halves fold together but can be opened out for play.

18. A game according to claim 17, in which each playing area of the board is of square shape similar in size to a record album approximately 30.5 cm in dimension.

19. A game according to claim 5, in which one of said parts of the second playing area adjacent an end compartment is designated a platinum disc area and comprises from seven to nine compartments; a further one of the parts of the second playing area next to the platinum disc area and designated a gold disc are comprises from 14 to 18 consecutive compartments and a third one of the parts of the second playing area next to the gold disc area and designated a silver disc area comprises from 20 to 28 consecutive compartments and award tokens of different values are won by a counter staying in the platinum disc area for a predetermined plurality of consecutive players turns, staying in the gold disc area for a predetermined plurality of consecutive player turns or staying in the silver disc area for a predetermined plurality of consecutive player turns.

20. A game according to claim 5, which includes tokens marked with an indication which will enable a player to block a player's move when that token is played.

21. A game according to claim 5, which includes further tokens marked with a numeral indicating the number of positions which can be moved when the token is played which can be collected by the players as they move around one or both playing areas, these further tokens including some which allow the players to select or change the number of increments to be moved at a turn instead of using the random number selector means.

22. A game according to claim 5, in which the board, having first and second separate playing areas is constructed so that the playing areas coincide with two halves of the board whereby the two halves are connected by a fold line with the two playing areas on the two halves respectively, which halves fold together but can be opened out for play.

23. A game according to claim 22, in which each playing area of the board is of square shape similar in size to a record album approximately 30.5 cm in dimension.

* * * * *